US006319041B1

(12) United States Patent
Nishide et al.

(10) Patent No.: US 6,319,041 B1
(45) Date of Patent: Nov. 20, 2001

(54) CONNECTOR WITH POSITIVE LOCKING FEATURES

(75) Inventors: Satoru Nishide; Hajime Kawase; Ryotaro Ishikawa, all of Yokkaichi; Takahiro Yoneda, Kanagawa-ken, all of (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/666,439

(22) Filed: Sep. 21, 2000

(30) Foreign Application Priority Data

Sep. 22, 1999 (JP) ..... 11-269237

(51) Int. Cl.[7] ..... H01R 13/627
(52) U.S. Cl. ..... 439/352
(58) Field of Search ..... 439/352, 488, 439/489, 188

(56) References Cited

U.S. PATENT DOCUMENTS 5,672,073 * 9/1997 Matsumura et al. ..... 439/489
5,803,651 9/1998 Saito ..... 439/352
5,820,399 10/1998 Shirouzu et al. ..... 439/352
6,095,843 * 8/2000 Kaneko et al. ..... 439/352

FOREIGN PATENT DOCUMENTS 0 721 233 10/1996 (EP) .

* cited by examiner

*Primary Examiner*—Tho D. Ta
(74) *Attorney, Agent, or Firm*—Anthony J. Casella; Gerald E. Hespos

(57) ABSTRACT

A connector is provided with a highly reliable lock arm. The connector includes a slider (20) formed to move between a displacement permitting position to a forcible displacement position. The slider (20) and a lock arm (17) are provided with pushing portions (24) and a pushable portion (18), respectively. When the slider (20) is moved from the displacement permitting position to the forcible displacement position with connector housings (10, 40) fitted with each other, slanted surfaces (24A) of the pushing portions (24) push a slanted surface (18A) of the pushable portion (18) to forcibly displace the lock arm (17) to an unlocking position. Since it is not necessary to provide a locking portion of the lock arm (17) and the female connector housing (40) with an unlocking function, reliability of a locking function by the lock (17) can be improved.

10 Claims, 9 Drawing Sheets

CONNECTOR WITH POSITIVE LOCKING FEATURES

BACKGROUND OF THE INVENTION

1. Field of the Invention

The present invention relates to a connector.

2. Description of the Related Art

The inventors of the present application filed Japanese Patent Application No. 11-138558 and the corresponding European Patent Application No. 00 110 204.5, which relate to a connector with means for locking two housings into each other. The locking means is concealed inside to make it difficult to disengage the housings from the outside. This connector of JP 11-138558 also is shown in FIGS. 11(A) and 11(B) of this application, and is comprised of a male connector housing 101 and a female connector housing 102. A lock arm 103 is provided in the male housing 101 for locking the female connector housing 102. A slider 104 also is provided in the male housing 101 for holding the lock arm 103 in a position where the lock arm 103 can lock the female connector housing 102. The slider 104 is provided with compression coil springs (not shown) for accumulating biasing forces that act in a direction to separate the female connector housing 102 from the male connector housing 101 as the female connector housing 102 is fitted into the male connector housing 101.

A locking surface 103A at the leading end of the lock arm 103 engages the female connector housing 102 when the female connector housing 102 is connected properly with the male connector housing. Simultaneously, the slider 104 is displaced to the left of FIG. 11, where a displacement of the lock arm 103 in its disengaging direction is restricted by a pressing surface 104A of the slider 104. As a result, the connector housings 101, 102 are locked into each other (see FIG. 11(B)).

If the slider 104 is slid to the right of FIG. 11 in this locked state, the accumulated forces of the unillustrated compression coil springs are increased, and the restriction on the displacement of the lock arm 103 by the slider 104 is released. Accordingly, the lock arm 103 is displaced in the upward direction of FIG. 11 by a pushing force from the female connector housing 102. As a result, the female connector housing 102 is pushed out of the male connector housing 101 by the accumulated forces of the compression coil springs (see FIG. 11(A)).

The above-described lock arm 103 is concealed inside the male housing 101 to make it difficult to disengage the lock arm 103 from outside. Additionally, the lock arm 103 has both a locking function and an unlocking function. Specifically, the locking surface 103A of the lock arm 103 is slightly oblique with respect to a direction normal to a disengaging direction of the female connector housing 102. Thus, the pushing force from the female connector housing 102 on the inclined locking surface 103A displaces the lock arm 103 upward and disengages the lock arm 103 from the female connector housing 102 to effect unlocking.

The inclined locking surface 103A of the lock arm 103 is desirable in view of the unlocking function, but not desirable in view of the locking function.

The present invention was developed in view of the above problem, and an object thereof is to secure the reliability of a locking function of a lock arm.

SUMMARY OF THE INVENTION

The subject invention is directed to a connector that comprises first and second connector housings that are connectable with each other. The first connector housing comprises a lock arm that is elastically deformable between a locking position where the second connector housing is locked to the first connector housing and an unlocking position where the second connector housings is not locked.

The first connector housing further comprises a slider that is movable between a displacement-restricting position, where a displacement of the lock arm from the locking position toward the unlocking position is restricted, and a displacement-permitting position, where the displacement of the lock arm toward the unlocking position is permitted. The connector housings are locked into each other by displacing the lock arm to the locking position to lock the second connector housing and moving the slider to the displacement-restricting position. The connector housings can be released from the locked state for separation from each other by moving the slider to the displacement-permitting position and displacing the lock arm to the unlocking position. A forcible displacing means is provided in the slider and/or the lock arm for forcibly displacing the lock arm from the locking position to the unlocking position as the slider is moved from the displacement-restricting position to the displacement-permitting position.

Movement of the slider from the displacement-restricting position to the displacement-permitting position, while the connector housings are fitted with each other, causes the forcible displacing means to displace the lock arm to the unlocking position. Thus, it is unnecessary for the locking portion of the lock arm and the other connector housing to perform an unlocking function, and accordingly, the locking function performed by the lock arm is more reliable.

According to a preferred embodiment of the invention, the slider is further movable from the displacement-permitting position to a forcible displacement position, which preferably is located at substantially the opposite range of the movement of the slider from the displacement restricting position. The lock arm is displaced forcibly by the forcible displacing means as the slider is moved from the displacement-permitting position to the forcible displacement position. The forcible displacing means forcibly displaces the lock arm when the restriction on the displacement of the lock arm by the slider is released. Thus, the forcible displacing operation can be performed with high reliability.

The forcible displacing means preferably comprises a pushing portion formed on the slider and a pushable portion formed on the lock arm. At least one of the pushing portion and the pushable portion preferably are formed with a slanted surface that is inclined with respect to both the moving directions of the slider and displacing directions of the lock arm. The forcible displacing means takes advantage of the inclination of the slanted surface to displace the lock arm into the unlocking position. Thus, the construction can be simplified.

The connector may further comprise a holding means that permits movement of the slider from the displacement-permitting position toward the forcible-displacement position, but restricts movement of the slider toward the displacement-restricting position. The connector may further comprise a biasing means for biasing the slider from the forcible-displacement position toward the displacement-permitting position. The slider is held in the displacement permitting position by the biasing force of the biasing means. Thus the biasing means prevents the slider from shaking between the displacement-permitting position and the forcible-displacement position.

The restriction on the movement of the slider toward the displacement restricting position by the holding means preferably is released as the first connector housing is properly connected with the second connector housing.

The lock arm locks the housings together when the second connector housing is connected properly with the first connector housing, and, at this time, the restriction on the movement of the slider by the holding means is released. Thus, the slider is moved to the displacement restricting position by the biasing force of the biasing means. In other words, the connector housings automatically are locked together when they are properly connected, thereby saving a manual operation.

The biasing means preferably is deformed as the second connector housing is connected with the first connector housing, and thereby accumulates a biasing force. The accumulated biasing force then functions to separate the second connector housing. More particularly, the second connector housing is displaced forcibly in a separating direction by the biasing force accumulated in the biasing means if the connecting operation is interrupted halfway. Therefore, a partial connection can be prevented. The number of parts can be reduced since the biasing means for biasing the slider from the forcible displacement position to the displacement permitting position also performs a partial connection preventing function.

According to a further preferred embodiment of the invention, the slider comprises a shorting terminal for shorting terminal fittings in the one connector housing. Preferably, the shorting terminal shorts the terminal fittings when the slider is in the displacement-permitting portion and/or the forcible displacement position, whereas the shorted state of the terminal fittings is released when the slider is in the displacement-restricting portion.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
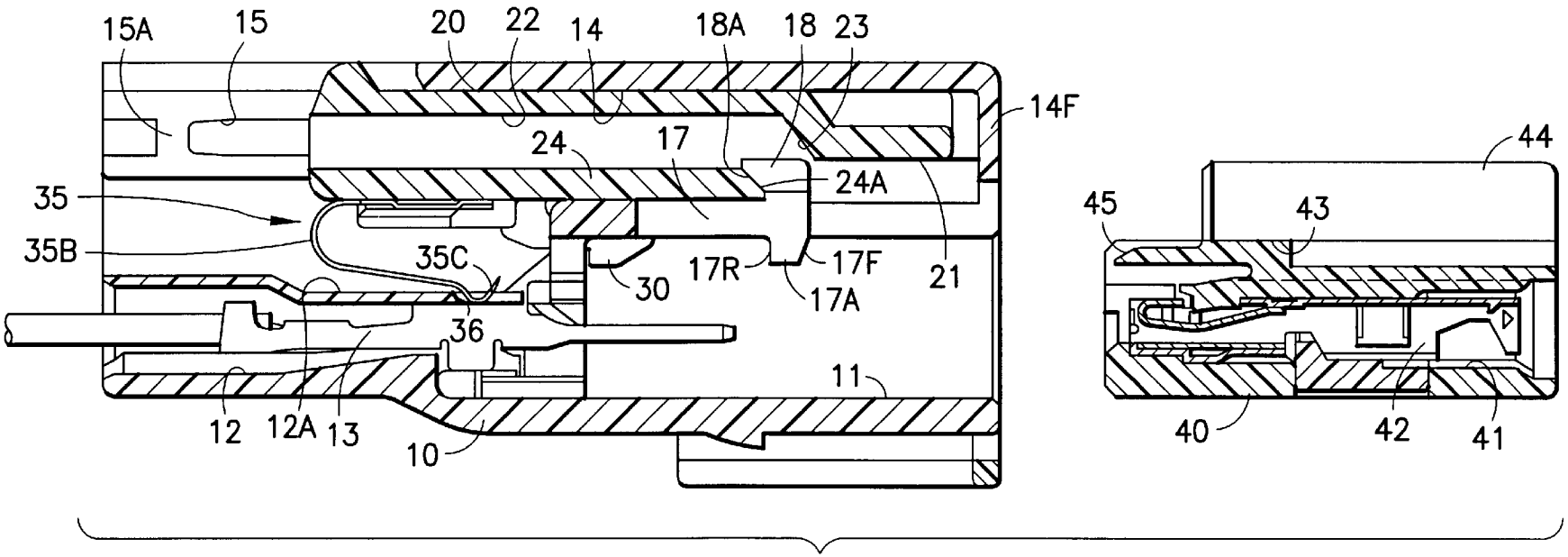
FIG. 1 is a section showing a state of a lock arm when male and female connector housings are separated.

A connector in accordance with the subject invention includes a male connector housing identified generally by the numeral 110 in FIGS. 1–10 and a female connector housing identified generally by the numeral 40. The male connector housing 10 includes male terminal fittings 13, a slider 20 and a shorting terminal 35. The female connector housing 40 includes female terminal fittings 42. The connector housings 10 and 40 are connectable with each other and are separable from each other. In the following description, the surfaces of the respective connector housings 10 and 40 that face the mating connector housings 40 and 10 are referred to as the front surfaces, and the vertical direction is based on the orientation shown FIGS. 1 to 6.

The female connector housing 40 has a plurality of cavities 41 arranged substantially side by side, and the female terminal fittings 42 are inserted at least partly into the respective cavities 41. A locking surface 43 is formed substantially in the center of the upper surface of the female connector housing 40 with respect to a widthwise or transverse direction. The locking surface 43 is slightly inclined with respect to a direction normal to a connecting direction of the housings 10 and 40. The angle and direction of the inclination of the locking surface 43 are substantially the same as those of a rear surface 17R of a locking projection 17A of a lock arm 17, as described below. Pushing portions 44, in the form of ribs, extend substantially parallel to the connecting direction at the opposite sides of the locking surface 43. A slanted or inclined guide surface 45 is formed at the front end of the upper surface of the female connector housing 40 and descends to the front.

A receptacle 11 is formed in a front and lower half of the male connector housing 10. The receptacle 11 is open in a forward direction, and is dimensioned to receive at least part of the female connector housing 40. Cavities 12 with a height lower than the receptacle 11 are formed substantially side by side behind the receptacle 11, and the male terminal fittings 13 are inserted at least partly in the respective cavities 12.

An accommodation space 14 is formed in an area of the male connector housing 10 above the receptacle 11 and the cavities 11. The accommodation space 14 is open at the rear surface of the male connector housing 10 and at and a rear half of the upper surface of the male connector housing 10. A front half of the accommodation space 14 communicates with the receptacle 11, and a rear half is partitioned from the cavities 12 by upper walls 12A. Guide grooves 15 are formed in the left and right inner wall surfaces of the accommodation space 14. The guide grooves 15 extend in forward and backward directions and each is formed at its rear end with a stopper 15A. Left and right escape grooves 16 are formed at the front end of the accommodation space 14 for at least partly receiving the pushing portions 44 of the female connector housing 40 into the accommodation space 14.

Figure 3A:
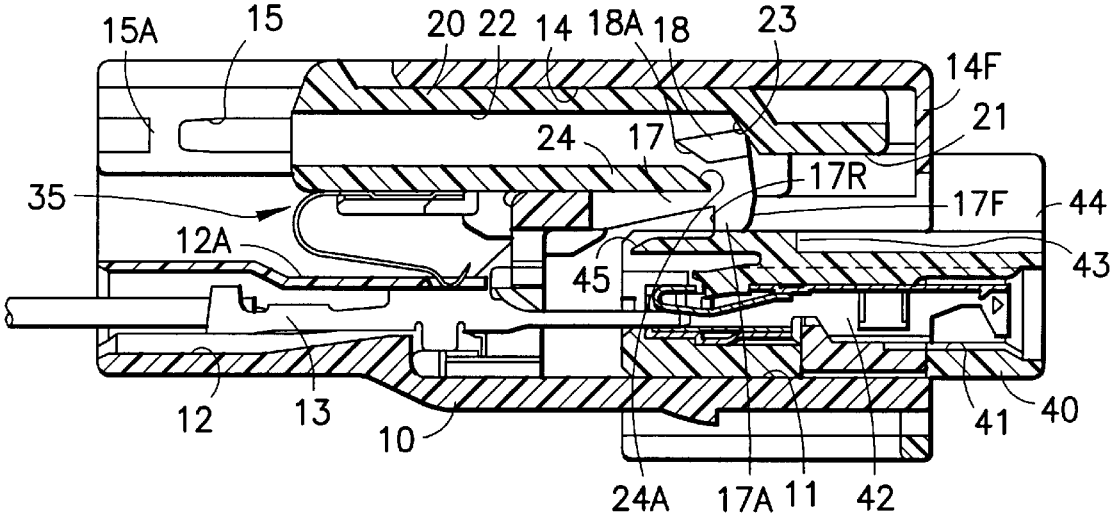
FIGS. 3(A) and 3(B) are sections showing a state of the lock arm and a state of the compression coil springs while the connector housings are being connected, respectively.
Figure 3B:
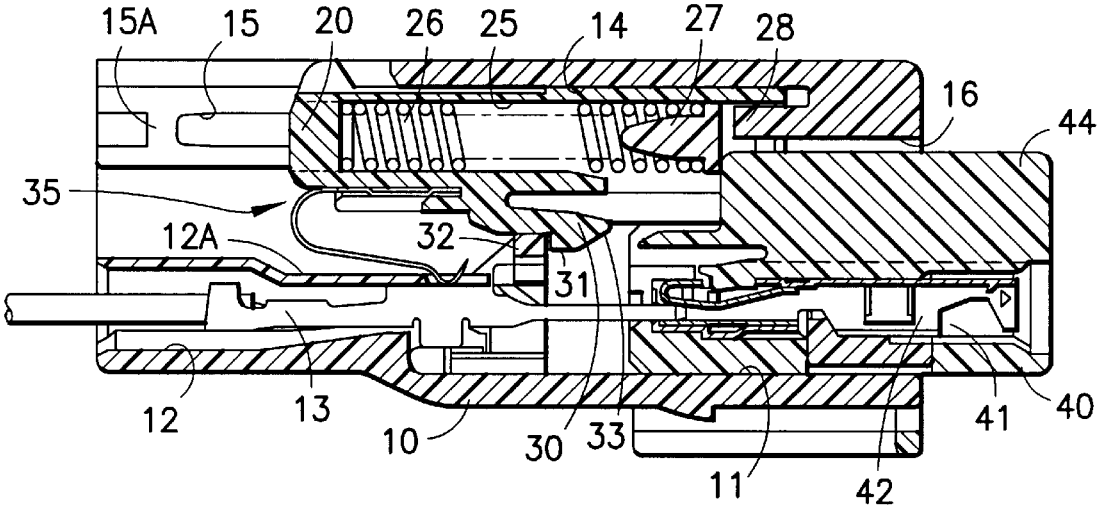
Figure 4A:
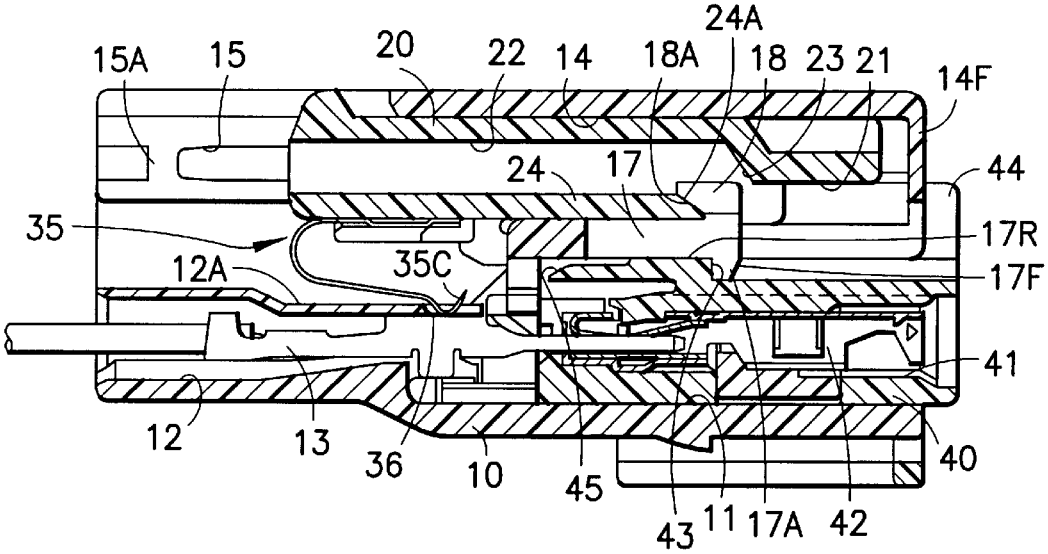
FIGS. 4(A) and 4(B) are sections showing a state of the lock arm and a state of the compression coil springs when the lock arm locks the connector housings into each other, respectively.
Figure 4B:
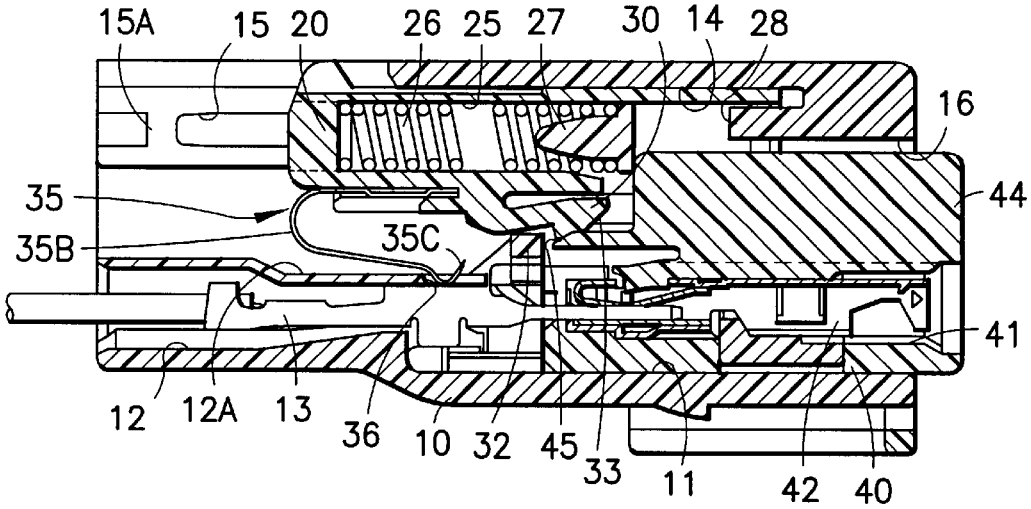
Figure 5A:
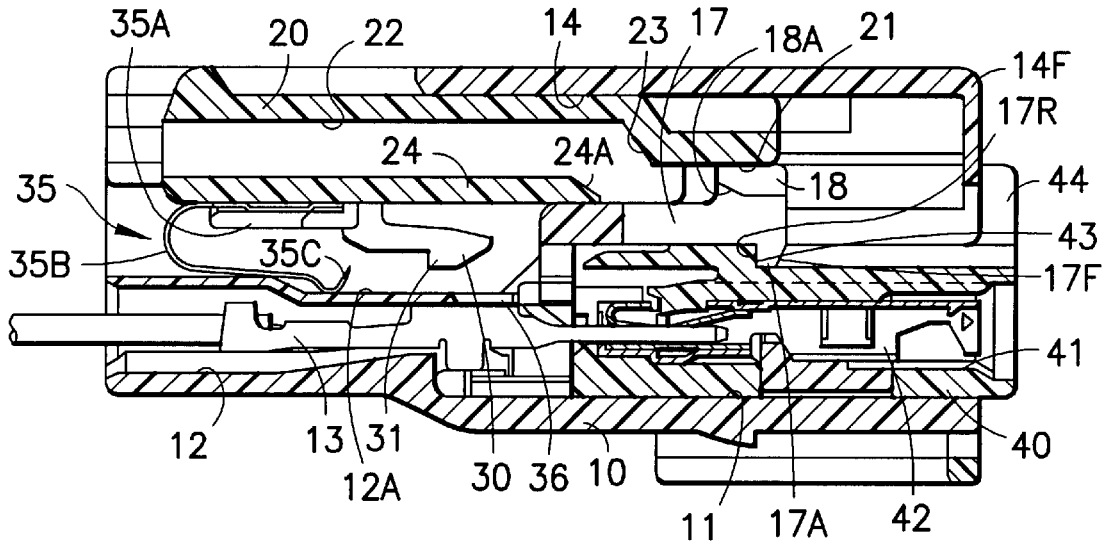
FIGS. 5(A) and 5(B) are sections showing a state of the lock arm and a state of the compression coil springs when a slider restricts a displacement of the lock arm, respectively.
Figure 5B:
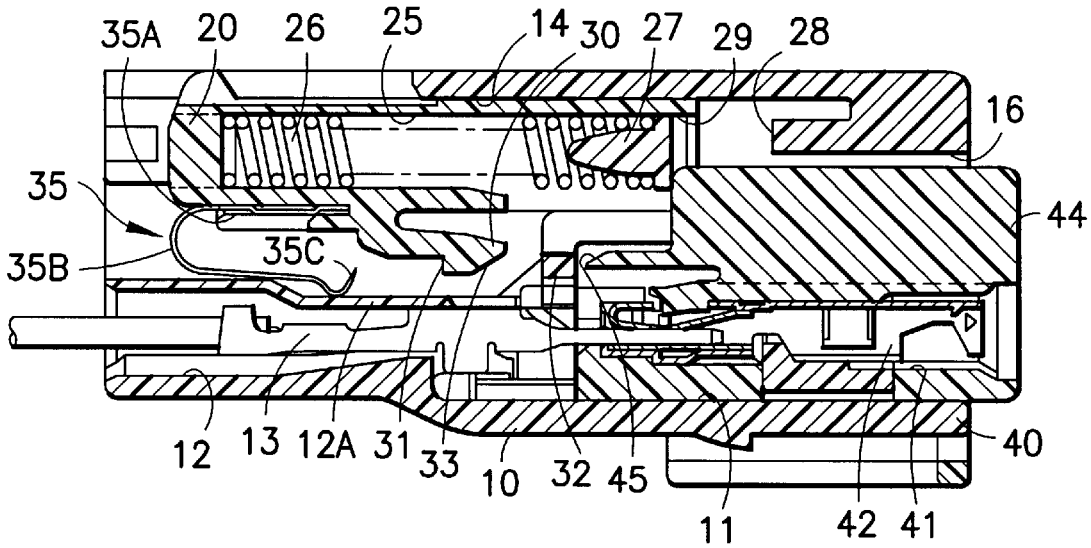

The lock arm 17 cantilevers forward along the boundary between the accommodation space 14 and the receptacle 11 in the middle of the male connector housing 10 with respect to a widthwise direction. The lock arm 17 is usually in a locking position as shown in FIGS. 1, 4 and 5. When an external force is exerted, the lock arm 17 is displaced elastically to an unlocking position, as shown in FIGS. 3 and 6, which is located above the locking position. The lock arm 17 is returned elastically substantially to the locking position when released from the external force in the unlocking position.

The front end of the lock arm 17 preferably is located substantially in a middle position of the receptacle 11 with respect to forward and backward directions, and a locking projection 17A projects down from the lock arm 17 for engagement with the locking surface 43. The rear surface 17R of the locking projection 17A is slightly inclined with respect to the direction normal to the connecting direction of the connector housings 10 and 40, such that the rear surface 17R extends obliquely to the back from its upper end to its bottom end. Accordingly, the locking projection 17A is locked with its bottom end portion held substantially in contact with the locking surface 43. Even if a force acts in a direction to separate the connector housings 10 and 40 in this locked state, the locking projection 17A is not displaced upward in a direction that would disengage the locking projection 17A from the locking surface 43. As a result, secure locking can be ensured.

A slanted or inclined guide surface 17F is formed on the front surface of the locking projection 17A for contacting the slanted guide surface 45 of the female connector housing 40 during the connection of the connector housings 10 and 40. The engagement of the slanted guide surfaces 45 and 17F causes a connecting force of the connector housings 10 and 40 to generate an upward pushing force on the lock arm 17 that pushes the lock arm toward the unlocking position.

A pushable portion 18 is formed at the front end of the locking arm 17 and defines a forcible displacing means for forcibly displacing the lock arm 17 to its unlocking position by the slider 20. The pushable portion 18 projects upward from the upper surface of the lock arm 17 and projects sideways from the left and right side surfaces of the lock arm 17. A slanted surface 18A is formed at the rear surface of the pushable portion 18. The slanted surface 18A is inclined with respect to both the forward and backward moving directions of the slider 20 and the vertical displacing directions of the lock arm 17. Thus, the slanted surface 18A extends obliquely to the back from the bottom end to the upper end. Accordingly, when a forward acting pushing force is exerted on the slanted surface 18A from behind, an upward pushing force acts on the lock arm 17 to urge the locking arm toward the unlocking position.

The slider 20 has a function of forcibly displacing the lock arm 17 to the unlocking position in addition to a function of restricting and permitting the displacement of the lock arm 17 between the locking position and the unlocking position. The slider 20 is movable in forward and backward directions in the accommodation space 14 by at least partly inserting its guidable portions (not shown) on the left and right side surfaces into the guide grooves 15. A displacement-restricting position (see FIG. 5) is defined at the rear end of a moving path of the slider 20, where any further backward movement of the slider 20 is restricted by contact of the guidable portions with the stoppers 15A. On the other hand, a forcible displacement position (see FIG. 6) is defined at the front end of the moving path of the slider 20 where a forward movement of the slider 20 is stopped by contact between the slider 20 and a front wall 14F of the accommodation space 14. Further, a displacement-permitting position (see FIGS. 1 to 4) is defined slightly backward from the forcible displacement position.

A displacement-restricting surface or portion 21 is formed at the front end of a middle part of the lower surface of the slider 20 with respect to the widthwise direction. The slider 20 contacts the upper surface of the pushable portion 18 of the lock arm 17 in its locking position while being moved to the displacement-restricting position, thereby restricting the displacement of the lock arm 17 to the unlocking position (see FIG. 5). A deformation-permitting space 22 is defined behind the displacement restricting surface 21 in the slider 20, and opens downward or on a side to face the lock arm 17. When the slider 20 is in the displacement-permitting position or a position more toward the forcible displacement position (forward) than the displacement-permitting position, the lock arm 17 is displaced to the unlocking position and enters the deformation permitting space 22 (see FIGS. 3 and 6). A backward movement-restricting surface 23 is formed at the front end of the deformation-permitting space 22, and is substantially continuous with the rear end of the displacement restricting surface 21. With the slider 20 in the displacement permitting position and the lock arm 17 displaced to the unlocking position, a backward movement of the slider 20 toward the displacement-restricting position is restricted by contact of the backward movement restricting surface 23 with the front surface of the pushable portion 18 of the lock arm 17 (see FIG. 3).

The slider 20 is formed with left and right pushing portions 24, which function as the forcible displacing means. The pushing portions 24 project inwardly from the bottom ends of the left and right inner side surfaces of the deformation permitting space 22. The pushing portions 24 are elongated in forward and backward or moving directions of the slider 20, and are provided in positions that are retracted sideways from a displacement area of the lock arm 17 to avoid interference with the lock arm 17 that is displacing to the unlocking position. The pushing portions 24 are positioned transversely to overlap or correspond to portions of the pushable portion 18 of the lock arm 17 that project to the left and the right. Additionally, the pushing portions 24 are positioned vertically at the same height as the pushable portion 18 when the lock arm 17 is in the locking position. A slanted surface 24A is formed at the front surface of each pushing portion 24 and is inclined backward with respect to the moving directions of the slider 20 so as to descend obliquely to the front. The angle of inclination of the slanted surfaces 24A is set substantially the same as the slanted surface 18A of the pushable portion 18 when the lock arm 17 is in the locking position. When the slider 20 is in the displacement-restricting position (see FIG. 5), the slanted surfaces 24A of the slider 20 are distanced from the slanted surface 18A of the lock arm 17. On the other hand, the slanted surfaces 24A and 18A are opposed to each other and substantially in contact when the slider 20 is in the displacement-permitting position and the lock arm 17 is in the unlocking position (see FIGS. 1 and 4). As the slider 20 is moved from the displacement-permitting position to the forcible displacement position, the lock arm 17 is pushed forcibly up from the locking position to the unlocking position. Simultaneously, the slanted surface 18A is in sliding contact with the slanted surfaces 24A of the slider 20.

Spring chambers 25 are formed at opposite sides of the deformation-permitting space 22 in the slider 20, and compression coil springs 26 are in the spring chambers 25. The longitudinal axes of the springs 26 extend in forward and backward directions, which are the same as the moving directions of the slider 20. Spring washers 27 that have a flat front surface are mounted at the front ends of the compression coil springs 26. On the other hand, spring contact portions 28 project backward from the front wall 14F of the accommodation space 14 and receiving grooves 29 are formed in the front wall of the spring chambers 25 for permitting the upper front ends of the pushing portions 44 of the female connector housing 40 into the spring chambers 25. When the slider 20 is in the displacement-permitting position or a forward position more toward the forcible-displacement position than the displacement-permitting position, the spring contact portions 28 enter the spring chambers 25 and contact the spring washers 27, to compress the compression coil springs 26 elastically (see FIGS. 2 and 3). Therefore, the slider 20 is biased backward with respect to the male connector housing 10.

Left and right elastic holding pieces 30 are formed on the bottom surface of the slider 20, and define cantilevers that project forwardly toward the female connector housing 40. The elastic holding pieces 30 are elastically displaceable upward. A holding projection 31 is formed on the lower surface of each holding piece 30 and extends substantially normal to the moving directions of the slider 20. When the slider 20 is in the displacement-permitting position, the elastic restoring forces of the elastic holding pieces 30 urge the holding projections 31 into engagement with receiving portions 32 at the upper edge of the rear end surface of the receptacle 11 to effect locking. This locking operation holds the slider 20 in the displacement-permitting position while its backward movement is restricted against the biasing forces of the compression coil springs 26 that act toward the displacement-restricting position.

Slanted surfaces 33 are formed at the lower surfaces of front end portions of the elastic holding pieces 30. With the holding projections 31 engaged against the receiving portions 32, the slanted surfaces 33 contact the slanted guide surfaces 45 of the female connector housing 40 substantially at the same time the connector housings 10 and 40 are connected properly, and the elastic holding pieces 30 are disengaged from the receiving portions 32 while moving onto the slanted guide surface 45. As a result, the function of the elastic holding pieces 30 to hold the slider 20 is canceled.

The compression coil springs 26 of the slider 20 cooperate with the pushing portions 44 of the female connector housing 40 to function as partial connection preventing means. Specifically, during the connection of the connector housings 10 and 40, the front ends of the pushing portions 44 enter the spring chambers 25 of the slider 20 in the displacement permitting position, and elastically compress the compression coil springs 26 as the connection progresses. In other words, the compression coil springs 26 accumulate the biasing forces by being compressed during connection of the female connector housing 40, and then use the accumulated biasing forces to separate the female connector housing 40 by pushing the female connector housing 40 out of the receptacle 11.

A base end 35A of the shorting terminal 35 is made e.g. of an electrically conductive plate member, and is mounted integrally or unitarily on a rear part of the bottom surface of the slider 20 for relative movement. The shorting terminal 35 is formed with a plurality of contact pieces 35B, which extend forward from the rear end of the base end 35A and substantially correspond to the respective cavities 12. Projecting ends of the contact pieces 35B serve as contact portions 35C with the male terminal fittings 13. When the slider 20 is in the displacement-permitting position or the forcible displacement position, the contact portions 35C of the shorting terminal 35 are held elastically in contact with the upper surface of the male terminal fittings 13 through rectangular holes 36 formed in the upper walls 12A of the cavities 12 (see FIGS. 1 to 4 and 6). In this state, the shorting terminal 35 shorts or connects the male terminal fittings 13 with each other. When the slider 20 is moved to the displacement restricting position, the contact portions 35C are moved away from the rectangular holes 36 and are brought into contact with the upper surface of the upper walls 12A of the cavities 12 (see FIG. 5). In this position, the shorted state of the male terminal fittings 13 is released.

Figure 2:
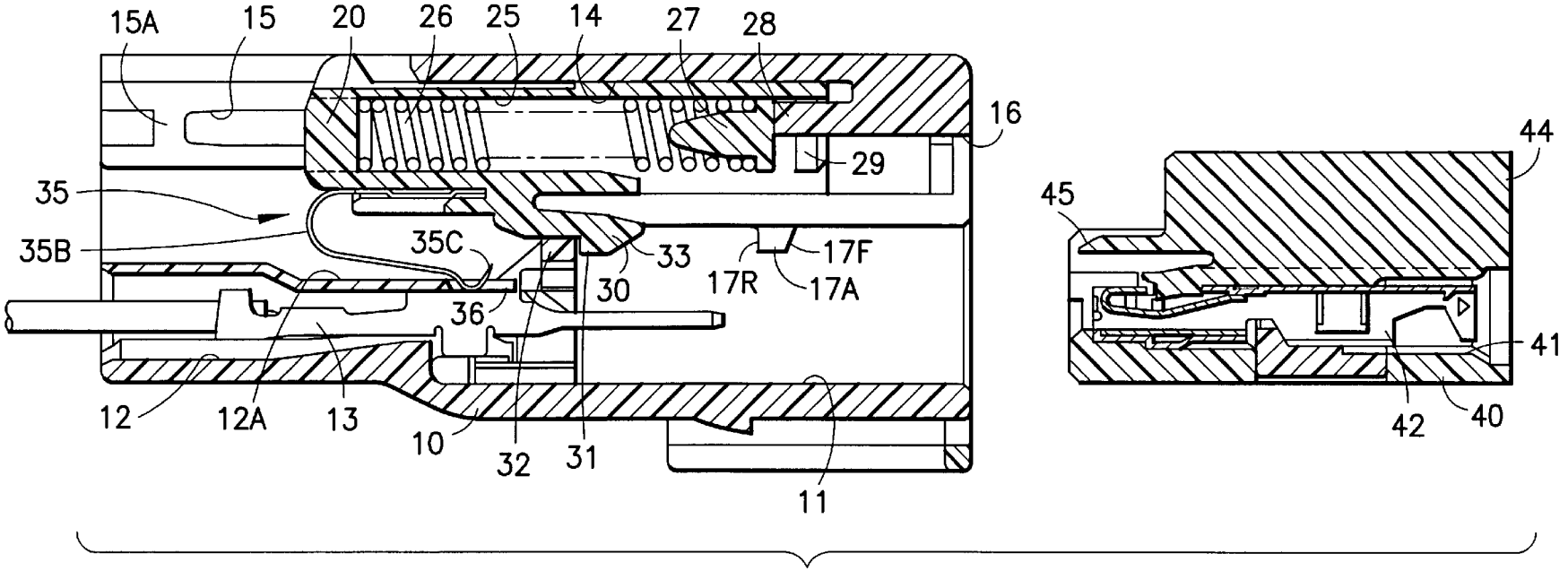
FIG. 2 is a section showing a state of compression coil springs when the connector housings are separated.

Prior to connecting the connector housings 10 and 40, the slider 20 is held in the displacement permitting position in the male connector housing 10 (see FIGS. 1 and 2). At this time, the slider 20 is biased backward by the compression coil springs 26 and has its backward movement restricted by the elastic holding pieces 30. If the female connector housing 40 is inserted into the receptacle 11 in this state, the lock arm 17 is displaced to the unlocking position while moving onto the upper surface of the female connector housing 40 and the compression coil springs 26 are compressed elastically by the pushing portions 44. As a result, a force is provided to separate the female connector housing 40 from the male connector housing 10 (see FIG. 8). Accordingly, if the connecting operation is interrupted halfway, the female connector housing 40 is pushed out of the receptacle 11 by the biasing forces of the compression coil springs 26. This prevents the connector housings 10 and 40 from being held partly connected.

When the connector housings 10 and 40 are connected properly, the lock arm 17 is returned elastically to the locking position to engage the locking projection 17A with the locking surface 43 of the female connector housing 40. As a result, the connector housings 10 and 40 are locked into each other, as shown in FIG. 4. As the connector housings 10, 40 are locked, the elastic holding pieces 30 are displaced elastically to disengage from the receiving portions 32 while moving onto the slanted guide surface 45 of the female connector housing 40, and the restriction on the backward direction of the slider 20 by the elastic holding pieces 30 is released.

The slider 20 then is moved backward from the displacement permitting position to the displacement restricting position by the biasing forces of the compression coil springs 26 (see FIG. 5). Unless the lock arm 17 is returned completely to the locking position, and even if the holding function of the elastic holding pieces 30 is released, the backward movement restricting surface 23 of the slider 20 interferes with the pushable portion 18 of the lock arm 17. Accordingly, the slider 20 remains in the displacement permitting position. When the slider 20 is moved to the displacement restricting position, the displacement-restricting surface 21 is brought into contact with the upper surface of the pushable portion 18 and presses the pushable portion 18 from above. Thus, the upward displacement of the lock arm 17 toward the unlocking position is restricted to secure the locked state of the locking projection 17A and the locking surface 43. In this way, the connector housings 10 and 40 are locked in the properly connected state, thereby completing the connecting operation.

Figure 6A:
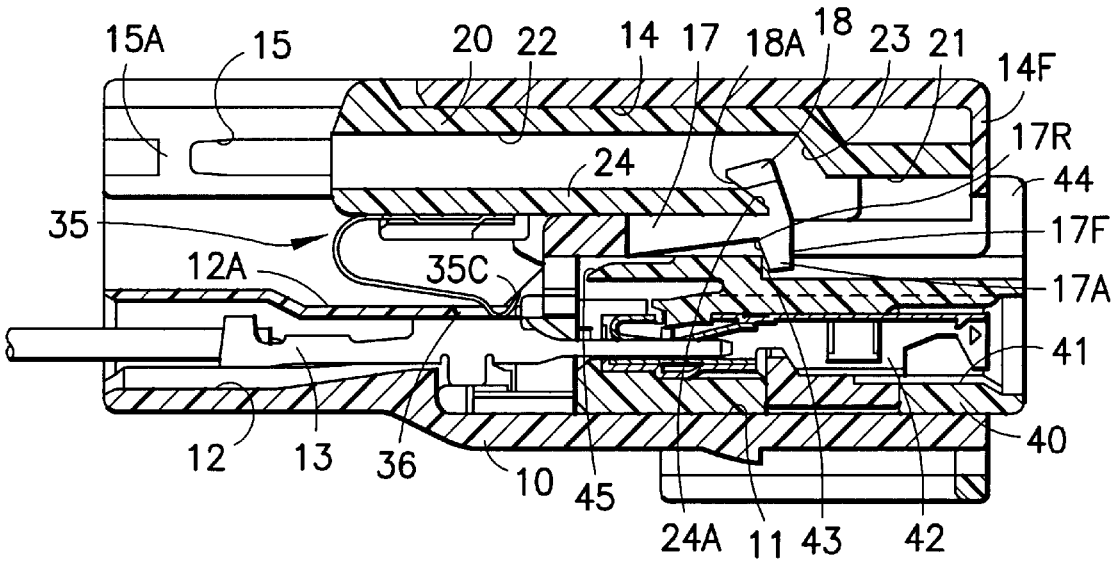
FIGS. 6(A) and 6(B) are sections showing a state of the lock arm and a state of the compression coil springs when locking by the lock arm is forcibly released, respectively.

The connector housings 10 and 40 that have been locked in the properly connected state are separated by first moving the slider 20 forward from the displacement restricting position, through the displacement permitting position and to the forcible displacement position. This movement is against the biasing forces of the compression coil springs 26. The slanted surfaces 24A of the pushing portions 24 of the slider 20 come into contact with the slanted surface 18A of the lock arm 17 to push the lock arm 17 up as shown in FIG. 6(A). In this way, the lock arm 17 is displaced forcibly from the locking position to the unlocking position to disengage the locking projection 17A from the locking surface 43 of the female connector housing 40. As a result the connector housings 10 and 40 are released from the locked state.

Figure 6B:
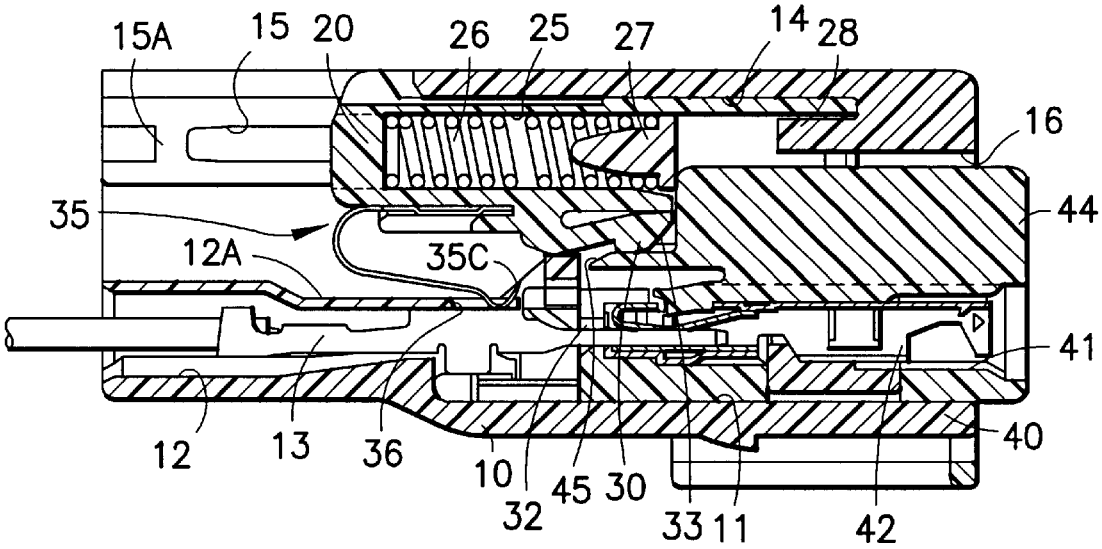
Figure 7:
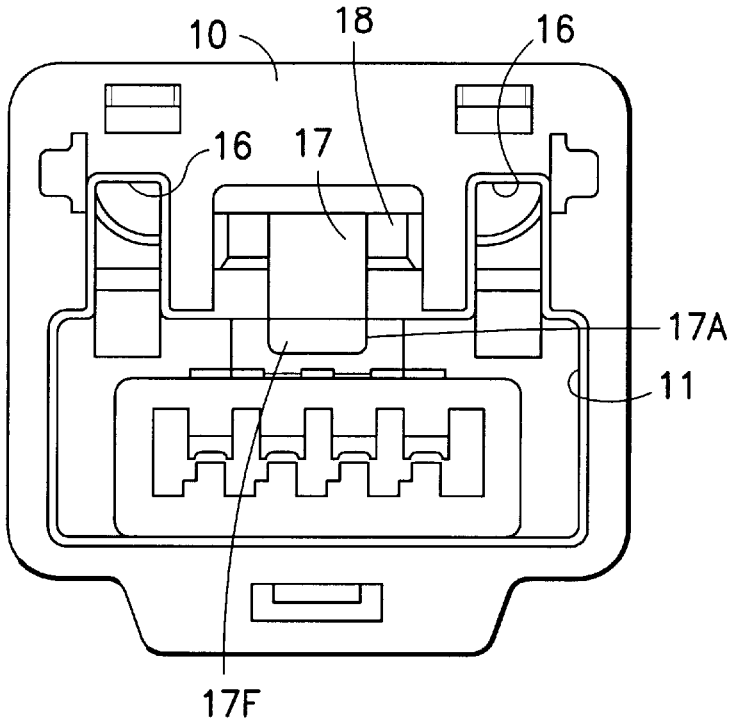
FIG. 7 is a front view of the male connector housing.
Figure 8:
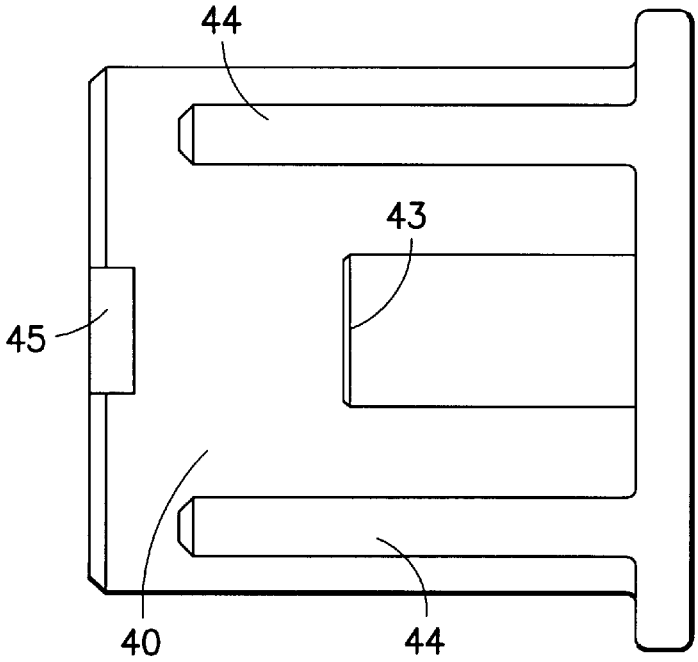
FIG. 8 is a plan view of the female connector housing.
Figure 9:
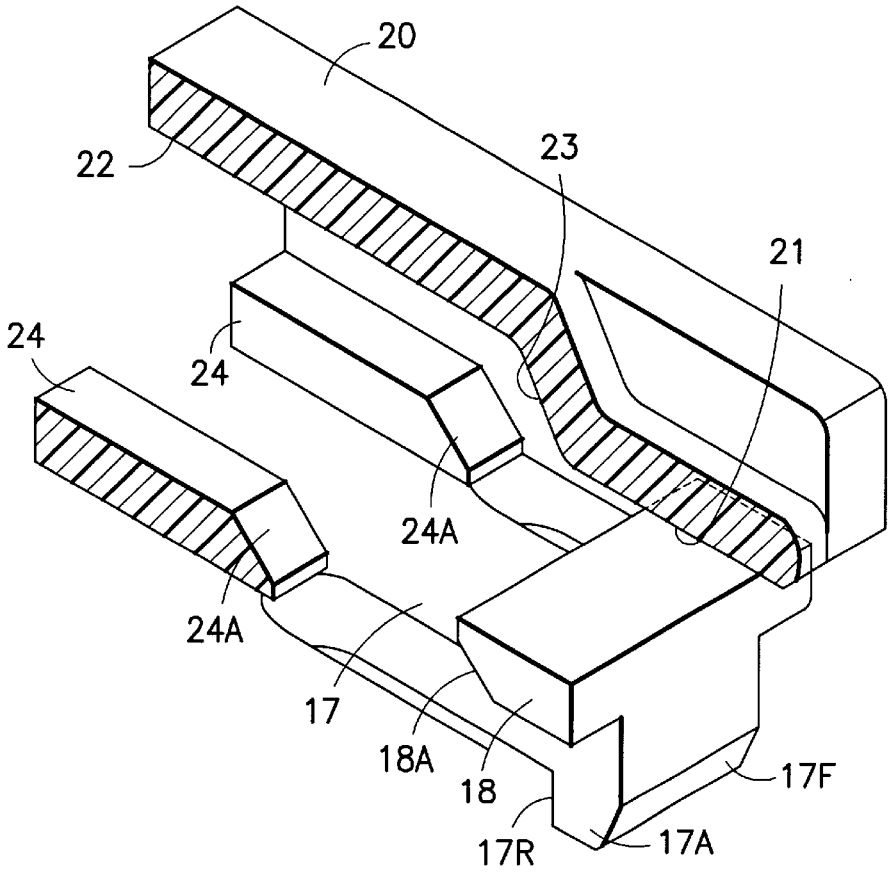
FIG. 9 is a perspective view partly in section showing a forcible displacing means.
Figure 10:
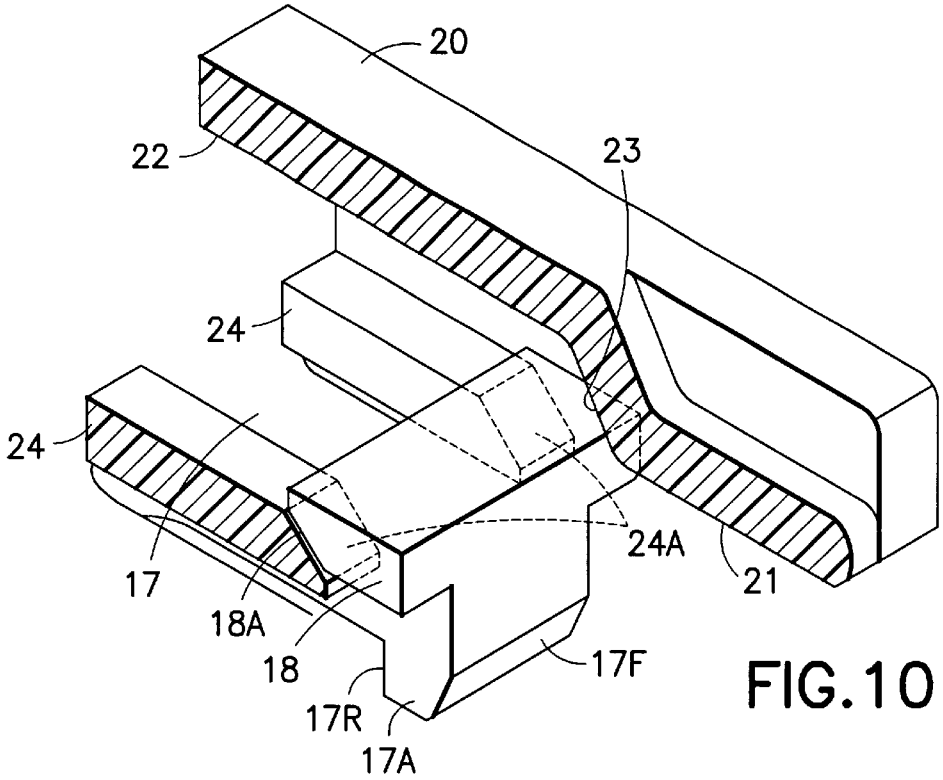
FIG. 10 is a perspective view partly in section showing the forcible displacing means.
Figure 11A:
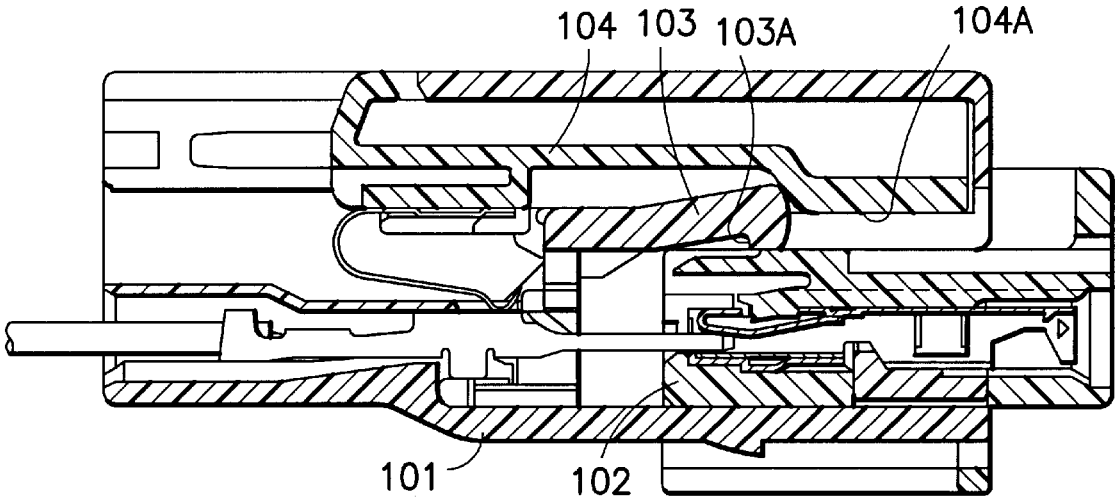
FIG. 11A PRIOR ART
FIGS. 11(A) and 11(B) are sections showing a prior art connector when connection of male and female connector housings is completed, and while the male and female connector housings are being separated.
Figure 11B:
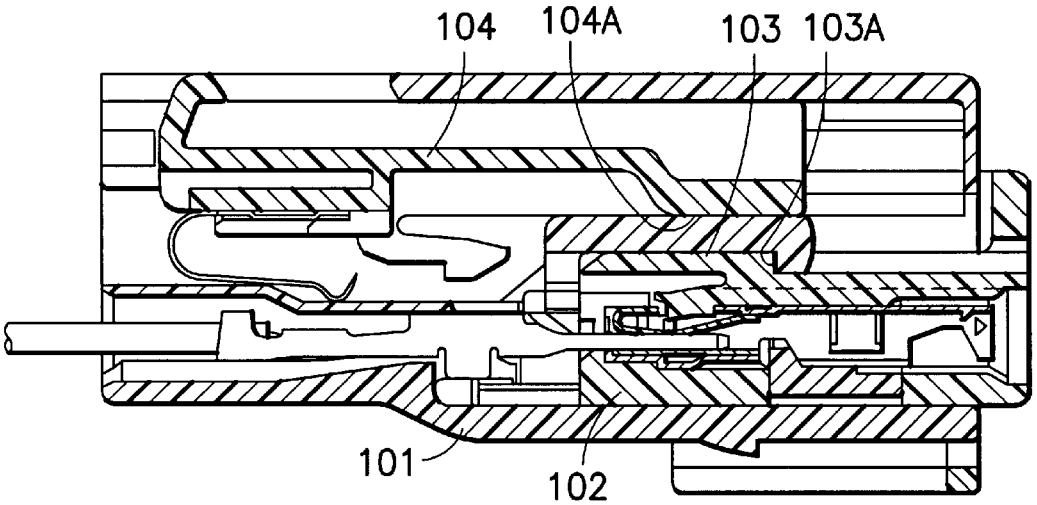
FIG. 11B PRIOR ART

At this stage, the compression coil springs 26 are compressed elastically between the rear end surfaces of the spring chambers 25 of the slider 20 and the front surfaces of the pushing portions 44 of the female connector housing 40, as shown in FIG. 6(B). Thus, the connector housings 10 and 40 are released from the locked state and, simultaneously, the female connector housing 40 is pushed out of the receptacle 11 by the biasing forces of the compression coil springs 26.

When the female connector housing 40 is pushed out, the elastic holding pieces 30 are disengaged from the slanted guide surface 45 to engage the receiving portions 32, thereby restricting the backward movement of the slider 20. As a result, the slider 20 is held in the displacement permitting position to enable the female connector housing 40 to be fitted or inserted.

The forcible displacing means (the pushing portions 24 and the pushable portion 18) for forcibly displacing the lock arm 17 to the unlocking position makes it unnecessary to provide a locking portion of the lock arm 17 and the female connector housing 40 with a slanted surface construction in order to realize an unlocking function. Accordingly, the rear surface 17R of the locking projection 17A of the lock arm 17 can be formed to overhang so that the locking projection 17A is not disengaged easily from the locking surface 43 of the female connector housing 40. This makes the locking function more reliable.

The forcible-displacing means displaces the lock arm 17 to the unlocking position by taking advantage of the inclinations of the slanted surfaces 18A, 24A, which are inclined with respect to both the moving directions of the slider 20 and the displacing directions of the lock arm 17. Thus, the construction is simple and the unlocking operation is highly reliable.

The slider 20 is held in the displacement permitting position by the biasing forces of the compression coil springs 26 and the elastic holding pieces 30, and therefore is prevented from becoming shaky between the displacement permitting position and the forcible displacement position. This shake preventing function prevents the shorting terminal 35 and the male terminal fittings 13 from being held in sliding contact with each other.

The restriction on the movement of the slider 20 toward the displacement restricting position by the elastic holding pieces 30 is released when the connector housings 10 and 40 are connected properly with each other, and the slider 20 restricts the displacement of the lock arm 17 automatically. Accordingly, a manual operation to move the slider 20 from the displacement permitting position to the displacement restricting position becomes unnecessary, thereby presenting an excellent operability.

In the case that the connecting operation of the connector housings 10 and 40 is interrupted halfway, the female connector housing 40 is displaced forcibly to separate from the male connector housing 10 by the biasing forces accumulated in the compression coil springs 26. Accordingly, the partial connection of the connector housings 10 and 40 can be prevented. Further, since the compression coil springs 26 for biasing the slider 20 from the forcible displacement position toward the displacement permitting position also are provided with a partial connection preventing function, the number of parts can be reduced and the construction can be simplified, as compared to a case where a special partial connection preventing means is separately provided.

The present invention is not limited to the above described and illustrated embodiment. For example, following embodiments are also embraced by the technical scope of the invention as defined in the claims. Besides these embodiments, various changes can be made without departing from the scope and spirit of the invention as defined in the claims.

Although the slanted surfaces are formed on both the pushing portions of the slider and the pushable portion of the lock arm in the foregoing embodiment, the slanted surface (s) may be formed on either one of the pushable portion and the pushing portions according to the present invention.

The holding means and the biasing means are provided to prevent the slider from shaking between the displacement permitting position and the forcible displacement position in the foregoing embodiment. However, the shake preventing means may be deleted according to the present invention.

Although the lock arm is forcibly displaced to the unlocking position while the slider is being displaced from the displacement permitting position to the forcible displacement position located substantially opposite from the displacement restricting position in the foregoing embodiment, it may be forcibly displaced during the movement of the slider from the displacement restricting position toward the displacement permitting position without providing the forcible displacement position according to the present invention.

What is claimed is:

1. A connector comprising first and second connector housings that are connectable with each other, the first connector housing comprising:

a lock arm substantially elastically deformable between a locking position where the second connector housing is locked and an unlocking position where the second connector housings is unlocked, a slider movable between a displacement restricting position where a displacement of the lock arm in the locking position toward the unlocking position is restricted and a displacement permitting position where the displacement of the lock arm toward the unlocking position is permitted, the slider further being movable from the displacement permitting position to a forcible displacement position, the connector housings being locked into each other by displacing the lock arm to the locking position to lock the second connector housing and moving the slider to the displacement restricting position, the connector housings being released from the locked state to separate from each other by moving the slider to the displacement permitting position and displacing the lock arm to the unlocking position, and a forcible displacing member comprising a pushing portion formed on the slider and a pushable portion formed on the lock arm for forcibly displacing the lock arm from the locking position to the unlocking position as the slider is moved from the displacement restricting position to the displacement permitting position, at least one of the pushing portion and the pushable portion being formed with a slanted surface inclined with respect to both moving directions of the slider and displacing directions of the lock arm, the lock arm being forcibly displaced by the forcible displacement member as the slider is moved from the displacement permitting position to the forcible displacement position;

a holding member cantilevered from the slider and configured for permitting movement of the slider in the displacement permitting position toward the forcible displacement position and restricting movement of the slider toward the displacement restricting position, and a biasing member mounted in the slider for biasing the slider from the forcible displacement position toward the displacement permitting position, wherein the lock arm is forcibly displaced by the forcible displacing member as the slider is moved from the displacement permitting position to the forcible displacement position, and wherein restriction on the movement of the slider toward the displacement restricting position by the holding member is released as the first connector housing is properly connected with the second connector housing.

2. A connector according to claim 1, wherein the forcible displacement position is located at a substantially opposite side from the displacement restricting position.

3. A connector according to claim 1, wherein the biasing member accumulates a biasing force to separate the second connector housing by being elastically deformed when the second connector housing is connected.

4. A connector according to claim 1, wherein the slider comprises a shorting terminal for shorting terminal fittings provided in the first connector housing.

5. A connector according to claim 4, wherein the shorting terminal shorts the terminal fittings when the slider is in either of the displacement permitting portion and the forcible displacement position, whereas the shorted state of the terminal fittings is released when the slider is in the displacement restricting portion.

6. A connector, comprising:

a first housing having opposed front and rear ends, a receptacle extending into the front end of the first housing;

a second housing selectively insertable in the receptacle of the first housing;

a resiliently deflectable lock arm formed on the first housing and configured for locked engagement with the second housing when the second housing is inserted properly in the receptacle of the first housing;

a slider disposed in the first housing in proximity to the lock arm and being slidable between a front position and a rear position, the slider having a front end defining a displacement restricting portion configured for restricting displacement of the lock arm when the slider is in the rear position, the slider further having a rear end defining a forcible displacement surface configured for displacing said lock arm away from the second housing when the slider is in the front position, portions of the slider between the displacement restricting portion and the forcible displacement surface being configured for permitting displacement of the lock arm; and at least one spring for urging the slider toward the rear position.

7. A connector according to claim 6, wherein the rear end of the first housing includes an open portion configured for accessing the slider to enable pushing of the slider toward the front end of the first housing and against forces exerted by the spring.

8. A connector according to claim 7, wherein the forcible displacement surface of the slider is slanted with respect to the sliding direction of the slider.

9. A connector according to claim 7, wherein the slider further comprises a holding member releasably engageable with a portion of the first housing for holding the slider in the front position, the second housing being configured for disengaging the holding member from the first housing when the second housing (40) is inserted properly in the receptacle of the first housing, such that the spring propels the slider into the rear position for restricting displacement of the lock arm when the second housing is inserted properly in the receptacle.

10. A connector, comprising:

a first housing having a receptacle;

a second housing selectively insertable in the receptacle of the first housing;

a resiliently deflectable lock arm formed on the first housing and configured for locked engagement with the second housing when the second housing is inserted properly in the receptacle of the first housing; and a slider disposed in the first housing in proximity to the lock arm and being slidable between a first position and a second position, the slider having a displacement restricting portion configured for restricting displacement of the lock arm when the slider is in the second position, the slider further having a forcible displacement surface configured for directly contacting the lock arm and forcibly displacing the lock arm away from the second housing when the slider is in the first position, portions of the slider between the displacement restricting portion and the forcible displacement surface being configured for permitting displacement of the lock arm.

* * * * *